US009742067B2

(12) United States Patent
Kim

(10) Patent No.: US 9,742,067 B2
(45) Date of Patent: Aug. 22, 2017

(54) ANTENNA APPARATUS

(71) Applicant: LG INNOTEK CO., LTD., Seoul (KR)

(72) Inventor: Chang Wook Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 225 days.

(21) Appl. No.: 13/928,596

(22) Filed: Jun. 27, 2013

(65) Prior Publication Data

US 2014/0002310 A1 Jan. 2, 2014

(30) Foreign Application Priority Data

Jun. 28, 2012 (KR) ..... 10-2012-0070373

(51) Int. Cl.

| | |
|---|---|
| ***H01Q 9/04*** | (2006.01) |
| ***H01Q 1/22*** | (2006.01) |
| ***H01Q 1/24*** | (2006.01) |
| ***H01Q 9/42*** | (2006.01) |
| ***H01Q 5/364*** | (2015.01) |

(52) U.S. Cl.

CPC ..... *H01Q 9/04* (2013.01); *H01Q 1/2283* (2013.01); *H01Q 1/243* (2013.01); *H01Q 5/364* (2015.01); *H01Q 9/42* (2013.01)

(58) Field of Classification Search

CPC ..... H01Q 9/04
USPC ..... 343/700 MS
See application file for complete search history.

(56) References Cited

U.S. PATENT DOCUMENTS

| | | | | |
|---|---|---|---|---|
| 5,959,582 | A * | 9/1999 | Kawahata | H01Q 1/243 343/700 MS |
| 6,255,994 | B1 | 7/2001 | Saito | |
| 6,700,543 | B2 * | 3/2004 | Konishi | H01Q 1/38 343/700 MS |
| 2002/0190907 | A1 | 12/2002 | Konishi et al. | |
| 2003/0052827 | A1 | 3/2003 | Umehara et al. | |
| 2005/0007279 | A1 * | 1/2005 | Chang | H01Q 1/243 343/700 MS |
| 2009/0002244 | A1 * | 1/2009 | Woo | H01Q 1/38 343/702 |
| 2009/0322618 | A1 | 12/2009 | Shoji | |
| 2011/0037665 | A1 | 2/2011 | Ahn et al. | |
| 2011/0122043 | A1 | 5/2011 | Ridgeway | |
| 2012/0092220 | A1 | 4/2012 | Tani et al. | |
| 2012/0127056 | A1 | 5/2012 | Park et al. | |

(Continued)

FOREIGN PATENT DOCUMENTS

| | | |
|---|---|---|
| CN | 101615725 A | 12/2009 |
| CN | 201749938 U | 2/2011 |
| CN | 101071901 B | 2/2012 |

(Continued)

*Primary Examiner* — Dameon E Levi
*Assistant Examiner* — Walter Davis
(74) *Attorney, Agent, or Firm* — Birch, Stewart, Kolasch & Birch, LLP

(57) ABSTRACT

Disclosed is an antenna apparatus. The antenna apparatus includes a feeding pad for supplying a signal, a main device extended from the feeding pad, and a sub-device extended from the feeding pad and spaced apart from the main device while overlapping with the main device. The antenna apparatus includes the sub-device overlapped with the main device, so that the resonance frequency band of the antenna apparatus is enlarged.

5 Claims, 5 Drawing Sheets

(56) References Cited

U.S. PATENT DOCUMENTS

2012/0154240 A1 6/2012 Shirakawa et al.

FOREIGN PATENT DOCUMENTS

| | | | |
|---|---|---|---|
| JP | 2000-68726 | A | 3/2000 |
| JP | 2002-100915 | A | 4/2002 |
| JP | 2002-374115 | A | 12/2002 |
| JP | 2003-110344 | A | 4/2003 |
| JP | 2005-130249 | A | 5/2005 |
| JP | 3763764 | B2 | 1/2006 |
| JP | 2010-074489 | A | 4/2010 |
| JP | 2012-85215 | A | 4/2012 |
| KR | 10-2009-0012620 | A | 2/2009 |
| KR | 10-2009-0080697 | A | 7/2009 |
| KR | 10-2011-0124131 | A | 11/2011 |
| KR | 10-2012-0055981 | A | 6/2012 |

* cited by examiner (a)

(b)

ANTENNA APPARATUS

BACKGROUND

The disclosure relates to an antenna apparatus. More particularly, the disclosure relates to an antenna apparatus of a communication terminal.

In general, a wireless communication system provides various multimedia services such as global positioning system (GPS), Bluetooth, and Internet services. In this case, the high data rate for a huge amount of data must be ensured in order to smoothly provide the multimedia services in the wireless communication system. To this end, studies and researches have been conducted to improve the performance of the antenna apparatus in the communication terminal. This is because the antenna apparatus substantially transceives data in the communication terminal. The antenna apparatus operates at an appropriate resonance frequency band to transceive data.

However, the antenna apparatus has the narrow frequency band. Therefore, the communication terminal may include a plurality of antenna apparatuses to enlarge the resonance frequency band. However, since the installation space for the antennal apparatuses is required in the communication terminal, the difficulty is made when reducing the size of the communication terminal. In other words, it is impossible to use a wider resonance frequency band through a single antennal apparatus in the communication terminal.

SUMMARY

The disclosure provides an antenna apparatus having a wider resonance frequency band. In other words, the disclosure is to enlarge the resonance frequency band of the antenna apparatus while reducing the size of the antenna apparatus.

In order to accomplish the above object of the disclosure, there is provided an antenna apparatus including a feeding pad for supplying a signal, a main device extended from the feeding pad, and a sub-device extended from the feeding pad and spaced apart from the main device while overlapping with the main device.

In addition, there is provided an antenna apparatus including a substrate having a feeding pad for supplying a signal, a sub-device mounted on the substrate and extended from the feeding pad, a mounting member comprising a bottom surface mounted on the substrate and the sub-device and a top surface spaced apart from the bottom surface in one direction perpendicular to the bottom surface, and a main device extended from the feeding pad, mounted on the top surface, and overlapped with the sub-device through the mounting member.

As described above, the antenna apparatus according to the disclosure includes the sub-device overlapped with the main device, so that the resonance frequency band of the antenna apparatus can be enlarged. Therefore, the communication terminal can use a wider resonance frequency band through the single antenna apparatus. Accordingly, since the communication terminal does not require a plurality of antenna apparatuses, the size of the communication terminal can be reduced.

DETAILED DESCRIPTION OF THE EMBODIMENTS

Figure 1:
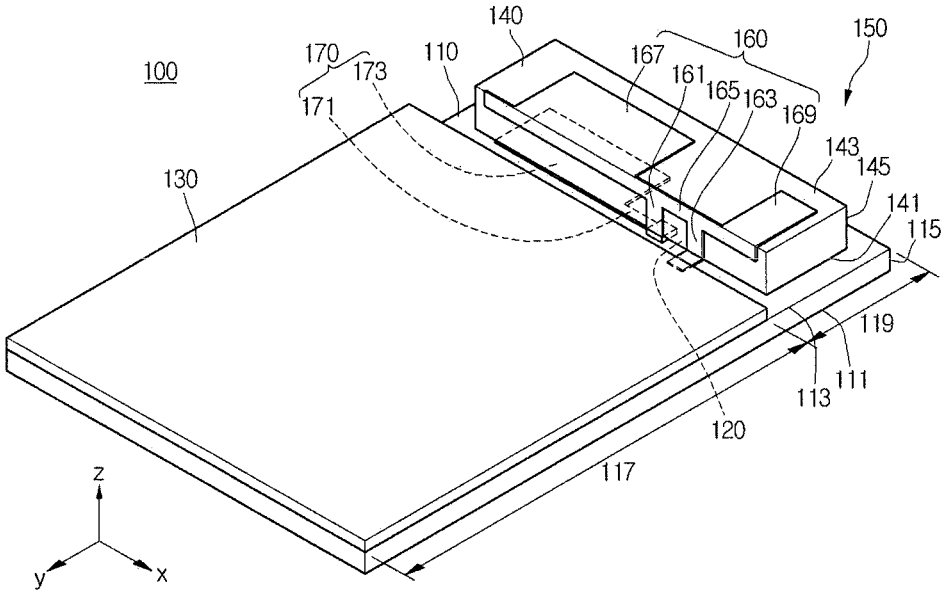
FIG. 1 is a perspective view showing an antenna apparatus according to one embodiment.

Hereinafter, the embodiments will be described in more detail wither reference to accompanying drawings. In the following description, for the illustrative purpose, the same components will be assigned with the same reference numerals. If it is determined that description about well known functions or configurations may make the subject matter of the embodiments unclear, the details thereof will be omitted.

Figure 2:
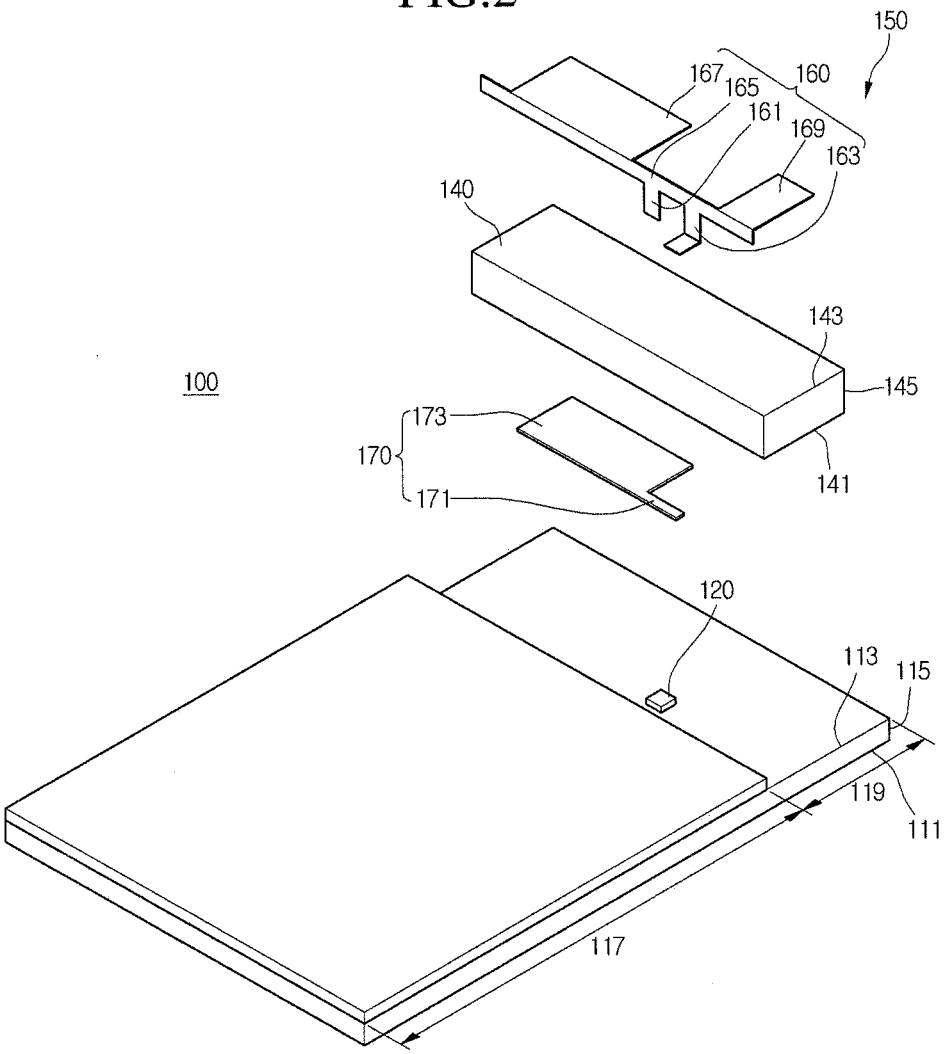
FIG. 2 is an exploded perspective view showing the antenna apparatus according to one embodiment.

FIG. 1 is a perspective view showing an antenna apparatus 100 according to one embodiment, and FIG. 2 is an exploded perspective view showing the antenna apparatus 100 according to one embodiment.

Referring to FIGS. 1 and 2, the antenna apparatus 100 according to the present embodiment includes a substrate 110, a grounding plate 130, a mounting member 140, and an antenna device 150.

The substrate 110 is provided for a power feeding operation and a support operation in the antennal apparatus 100. In this case, the substrate 110 may include a printed circuit board (PCB). The substrate 110 has a flat plate structure. In addition, the substrate 110 includes a dielectric material. For instance, the substrate 110 may include a dielectric material having the conductivity ($\sigma$) of 0.02 and the permittivity ($\in$) of 4.6. In this case, the substrate 110 may be realized as a single substrate, or may be realized in the structure in which a plurality of substrates are stacked. In addition, a transmission line (not shown) is embedded in the substrate 110. One end portion of the transmission line is connected to a control module (not shown) of the antennal apparatus 100.

In this case, the substrate 110 includes a substrate bottom substrate 111, a substrate top surface 113 corresponding to the substrate bottom substrate 111, and a top lateral side 115 connecting the substrate bottom substrate 111 to the substrate top surface 113. In this case, the substrate 110 is divided into a grounding region 117 and a device region 119. The substrate 110 includes a feeding pad 120. The feeding pad 120 is disposed at the device region 119 of the substrate top surface 113 of the substrate 110. The feeding pad 120 is connected to an opposite end portion of the transmission line. In other words, when the control module supplies signals, the signals are sent to the feeding pad 120 through the transmission line.

The grounding plate 130 is provided for the grounding operation in the antennal apparatus 100. The grounding plate 130 has a flat plate structure. In addition, the grounding plate 130 is disposed in the grounding region 117 of the substrate 110. Further, the grounding plate 130 is spaced apart from the feeding pad 120, so that the grounding plate 130 does not make contact with the feeding pad 120. In this case, the grounding plate 130 may be disposed on at least one of the substrate top surface 113 and the substrate bottom surface 111 of the substrate 110. The grounding plate 130 may cover the grounding region 117. In addition, when the substrate 110 includes a plurality of substrates, the grounding plate 130 may be disposed between the substrates.

The mounting member 140 is provided to mount the antenna device 150 thereon in the antennal apparatus 100. In this case, although not shown, when the antenna apparatus 100 is installed in the communication terminal, the mounting member 140 may be provided on the inner surface of an external case of the communication terminal. In this case, the substrate 110 may be disposed in the inner space formed in the external case of the communication terminal. The mounting member 140 is disposed in the device region 119 of the substrate top surface 113 of the substrate 110. The mounting member 140 may cover the feeding cover 120.

In addition, the mounting member 140 includes a dielectric material. In this case, the mounting member 140 may include a dielectric material having the same characteristic as that of the substrate 100, or may include a dielectric material having the characteristic different from that of the substrate 100. In this case, the mounting member 140 may include a dielectric material having a high loss ratio. For instance, the mounting member 140 may include a dielectric material having the conductivity ($\sigma$) of 0.02 and the permittivity ($\in$) of 4.6. In this case, the mounting member 140 includes a member bottom surface 141, a member top surface 143, and a member lateral side 145.

The member bottom surface 141 is disposed on the substrate top surface 113 in the device region 119 of the substrate 110. In this case, the member bottom surface 141 may cover the feeding pad 120. The member bottom surface 141 may have the same area as that of the device region 119, or may have an area different from that of the device region 119. In this case, the member bottom surface 141 may have an area larger than that of the device region 119, or may have the area smaller than that of the device region 119.

The member top surface 143 corresponds to the member bottom surface 141. In addition, the member top surface 143 is spaced apart from the member bottom surface 141 in one direction perpendicular to the member bottom surface 141. In this case, the member top surface 143 may have the same area as that of the member bottom surface 141, or may have the area different from that of the member bottom surface 141. In detail, the member top surface 143 may have the area larger than that of the member bottom surface 141, or may have the area smaller than that of the member bottom surface 141.

The member lateral side 145 connects the member bottom surface 141 to the member top surface 143. In this case, the member lateral side 145 has a height corresponding to the thickness of the mounting member 140. In this case, the member lateral side 145 may space the member bottom surface 141 apart from the member top surface 143 by a distance corresponding to the thickness of the mounting member 140.

The antenna device 150 transceives signals in the antennal apparatus 100. In this case, the antenna device 150 operates at a preset resonance frequency band to transceive an electromagnetic wave. In this case, the antenna device 150 makes resonance with preset impedance.

The antenna device 150 is disposed in the device region 119 of the substrate top surface 113 of the substrate 110. In this case, the antenna device 150 is connected to the feeding pad 120. The antenna device 150 has a structure branching from the feeding pad 120. In addition, the antenna device 150 adheres to the mounting member 140.

In addition, the antenna device 150 may be formed in a patch-type structure, and then attached to the substrate 110 or the mounting member 140. Alternatively, the antenna device 150 may be patterned in the substrate 110 or the mounting member 140. In this case, the antenna device 150 may have at least one of a bar-type structure, a meander-type structure, a spiral-type structure, a step-type structure, and a loop-type structure. The antenna device 150 includes a conductive material. The antenna device 150 may include at least one of silver (Ag), palladium (Pd), platinum (Pt), copper (Cu), gold (Au), and nickel (Ni).

In addition, the antenna device 150 includes a main device 160 and a sub-device 170. In this case, the mounting member 140 is interposed between the main device 160 and the sub-device 170.

The main device 160 makes contact with the feeding pad 120. In addition, the main device 160 is extended from the feeding pad 120. The main device 160 is mounted on the mounting member 140. In this case, the main device 160 is extended to the member top surface 143 of the mounting member 140. In this case, the main device 160 is extended to the member top surface 143 through the member lateral side 145 of the mounting member 140. In addition, the main device 160 makes contact with the grounding plate 130. The main device 160 includes a main feeding part 161, a main grounding part 163, a main connection part 165, a main radiation part 167, and a branch radiation part 169.

The main feeding part 161 receives an input signal in the main device 160. The main feeding part 161 makes contact with the feeding pad 120. The main feeding part 161 is disposed on the member lateral side 145 of the mounting member 140.

In this case, the main feeding part 161 may make contact with the feeding pad 120 at a connection portion between the member bottom surface 141 and the member lateral side 145. In addition, the main feeding part 161 may adhere to the member bottom surface 141 as well as the member lateral side 145. In this case, the main feeding part 161 may make contact with the feeding pad 120 on the member bottom surface 141. In addition, the main feeding part 161 may be bent at the connection portion between the member bottom surface 141 and the member lateral side 145 to adhere to the member lateral side 145.

The main grounding part 163 grounds the main device 160. The main grounding part 163 makes contact with the grounding plate 130. In addition, the main grounding part 163 is disposed on the member lateral side 145 of the mounting member 140. In addition, the main grounding part 163 is spaced apart from the main feeding part 161.

In this case, the main grounding part 163 may make contact with the grounding plate 130 at the connection portion between the member bottom surface 141 and the member lateral side 145. Further, the main grounding part 163 may adhere to the device region 119 of the substrate 110 as well as the member lateral side 145. In this case, the main grounding part 163 may make contact with the grounding plate 130 in the device region 119. In addition, the main grounding part 163 may be bent at the connection portion between the member bottom surface 141 and the member lateral side 145 to adhere to the member lateral side 145.

The main connection part 165 is provided for the connection of the main device 160. The main connection part 165 connects the main feeding part 161 to the main grounding part 163. In addition, the main connection part 165 is disposed on at least one of the member top surface 143 and the member lateral side 145 of the mounting member 140. In this case, the main connection part 165 makes contact with the main feeding part 161 while being provided in opposition to the feeding pad 120 about the main feeding part 161. In addition, the main connection part 165 makes contact with the main grounding part 163 while being provided in opposition to the grounding plate 130 about the main grounding part 163. In addition, the main connection part 165 is extended on the member top surface 143 or the member lateral side 145.

The main radiation part 167 substantially operates in the main device 160. The main radiation part 167 makes contact with the main connection part 165. In addition, the main radiation part 167 is extended from the main connection part 165. Further, the main radiation part 167 is disposed on the member top surface 143. In this case, the main radiation part 167 may make contact with the main connection part 165 at a connection portion between the member top surface 143 and the member lateral side 145. In addition, the main radiation part 167 may make contact with the main connection part 165 on the member top surface 143.

The branch radiation part 169 supports the operation of the main radiation part 167 in the main device 160. The branch radiation part 169 makes contact with the main connection part 165. In addition, the branch radiation part 169 is extended from the main connection part 165. In addition, the branch radiation part 169 is disposed on the member top surface 143. The branch radiation part 169 is spaced apart from the main radiation part 167. In this case, the branch radiation part 169 may make contact with the main connection part 165 at the connection portion between the member top surface 143 and the member lateral side 145. Alternatively, the branch radiation part 169 may make contact with the main connection part 165 on the member top surface 143.

The sub-device 170 makes contact with the feeding pad 120. In addition, the sub-device 170 is extended from the feeding pad 120. Further, the sub-device 170 is mounted on the mounted member 140. In this case, the sub-device 170 is extended along the member bottom surface 141 of the mounting member 140. In other words, the sub-device 170 overlaps with the main device 160 through the mounting member 140. In this case, a portion or the entire portion of the sub-device 170 overlaps with a portion or the entire portion of the main device 160. In this case, the sub-device 170 is spaced apart from the main device 160. In detail, the sub-device 170 is spaced apart from the main device 160 by a distance corresponding to the thickness of the mounting member 140. Further, the sub-device 170 may be open without making contact with the grounding plate 130. The sub-device 170 includes a sub-feeding part 171 and a sub-radiation part 173.

The sub-feeding part 171 receives input signal in the sub-device 170. The sub-feeding part 171 makes contact with the feeding pad 120 separately from the main feeding part 161. In addition, the sub-feeding part 171 is disposed on the member bottom surface 141 of the mounting member 140. In this case, the sub-feeding part 171 may be extended in a direction different from that of the main feeding art 161.

The sub-radiation part 173 substantially operates in the sub-device 170. The sub-radiation part 173 makes contact with the sub-feeding part 171. In addition, the sub-radiation part 173 is extended from the sub-feeding part 171. In addition, the sub-radiation part 173 makes contact with the member bottom surface 141. Further, the sub-radiation part 173 overlaps with the main radiation part 167 through the mounting member 140. In this case, a portion or the entire portion of the sub-radiation part 173 overlaps with a portion or the entire portion of the main radiation part 167. In this case, the sub-radiation part 173 is spaced apart from the main radiation part 167. In detail, the sub-radiation part 173 is spaced apart from the main radiation part 167 by the distance corresponding to the thickness of the mounting member 140.

Accordingly, when power is fed through the feeding pad 120, the antenna device 150 operates at the resonance frequency band. In other words, the antenna device 150 operates at the resonance frequency band according to the signal supplied from the feeding pad 120. In this case, the main device 160 and the sub-device 170 of the antenna device 150 may operate while being integrally formed with each other. In this case, the electrical characteristic of the antenna apparatus 100 is determined depending on the structure and the shape of the antenna device 150. In other words, main inductance is determined depending on the area of the main device 160, and main capacitance is determined depending on the interval between the main device 160 and the grounding plate 130. Meanwhile, sub-inductance is determined depending on the area of the sub-device 170, and sub-capacitance is determined depending on the interval between the sub-device 170 and the grounding plate 130. In addition, overlap capacitance is determined depending on the interval between the main device 160 and the sub-device 170 and the overlap area between the main device 160 and the sub-device 170.

Figure 3:
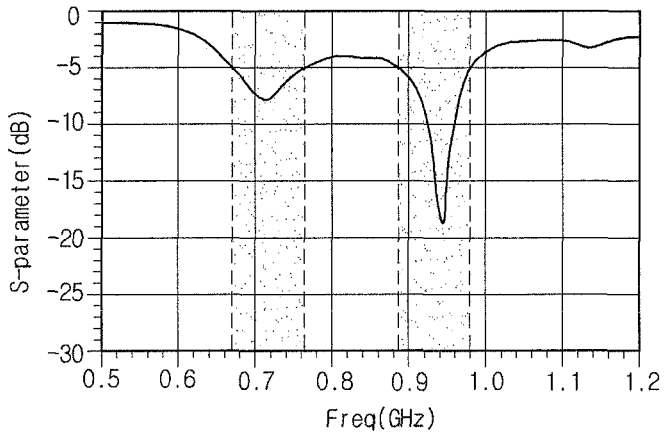
FIG. 3 shows graphs to explain the operating characteristic of the antenna apparatus according to one embodiment.
Figure 3:
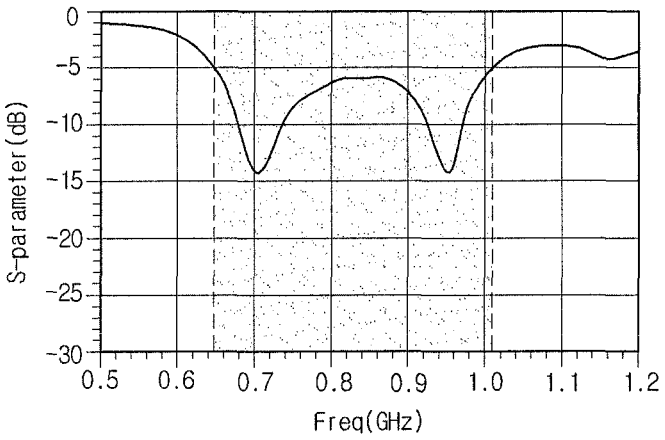

FIG. 3 shows graphs to explain the operating characteristic of the antenna apparatus 100 according to one embodiment. In detail, FIG. 3 shows the variation of an S-parameter as a function of a frequency band. In this case, the S-parameter is an index referring to an input/output voltage ratio (output voltage/input voltage) at a specific frequency band, and expressed in a dB scale. FIG. 3(*a*) shows the case that the antenna apparatus 100 does not include the sub-device 170, and FIG. 3(*b*) shows the case that the antenna apparatus 100 includes the sub-device 170.

Referring to FIG. 3, when the antenna apparatus 100 includes the sub-device 170, the antenna apparatus 100 operates at a wider resonance frequency band as compared with the resonance frequency band of the antenna apparatus 100 when the antenna apparatus 100 does not include the sub-device 170. In this case, the resonance frequency band represents a frequency band equal to or less than −5 dB. In other words, when the antenna apparatus 100 does not include the sub-device 170, the antenna apparatus 100 operates in the range of about 0.66 GHz to about 0.76 GHz and the range of about 0.89 GHz to about 0.97 GHz. On the contrary, when the antenna apparatus 100 includes the sub-device 170, the antenna apparatus 100 operates in the range of about 0.64 GHz to about 1.1 GHz.

In this case, depending on the presence of the sub-device 170, the resonance frequency band of the antenna apparatus 100 may include low frequency bands, which include a long term evolution (LTE) communication band corresponding to the range of 704 MHz to 798 MHz, a Global System for Mobile communications (GSM) communication band corresponding to the range of 824 MHz to 894 MHz, a Extension of GSM (EGSM) communication band corresponding to the range of 880 MHz to 960 MHz, and high frequency bands including a Digital Cordless System (DCS) communication band corresponding to the range of 1710 MHz to 1880 MHz, a Personal Communication System (PCS) communication band corresponding to the range of 1850 MHz to 1990 MHz, and an International Mobile Telecommunications (IMT) communication band corresponding to the range of 1920 MHz to 2170 MHz.

In other words, the resonance frequency band of the antenna apparatus 100 is enlarged according to the presence of the sub-device 170 in the antenna apparatus 100. Therefore, the resonance frequency band of the antenna apparatus 100 can be adjusted by adjusting at least one of the interval between the grounding plate 130 and the sub-device 170, and the internal and the overlap area between the main device 160 and the sub-device 170. That is to say, the resonance frequency band can be adjusted as at least one of the sub-capacitance and the overlap capacitance is adjusted.

Figure 4:
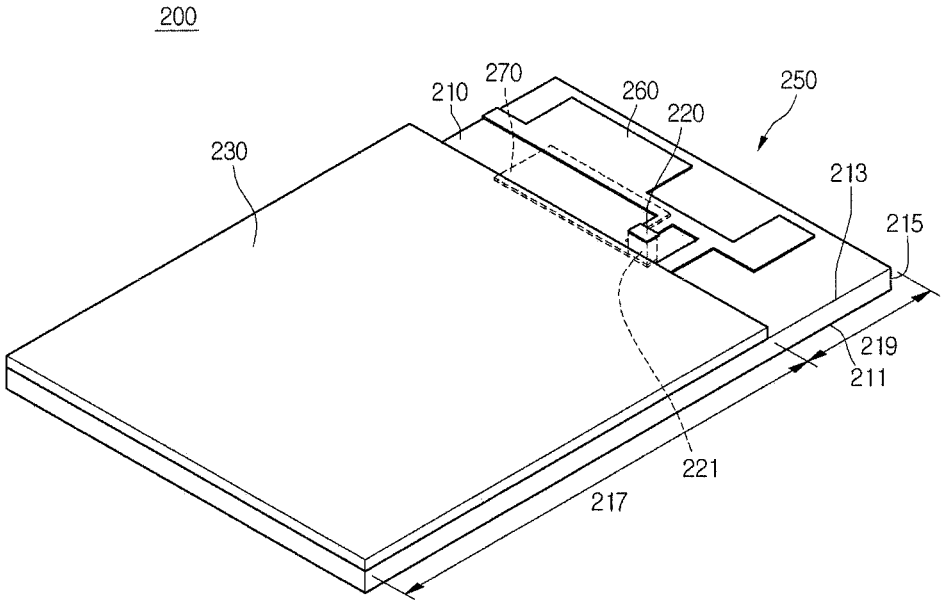
FIG. 4 is a perspective view showing an antenna apparatus according to another embodiment.
Figure 5:
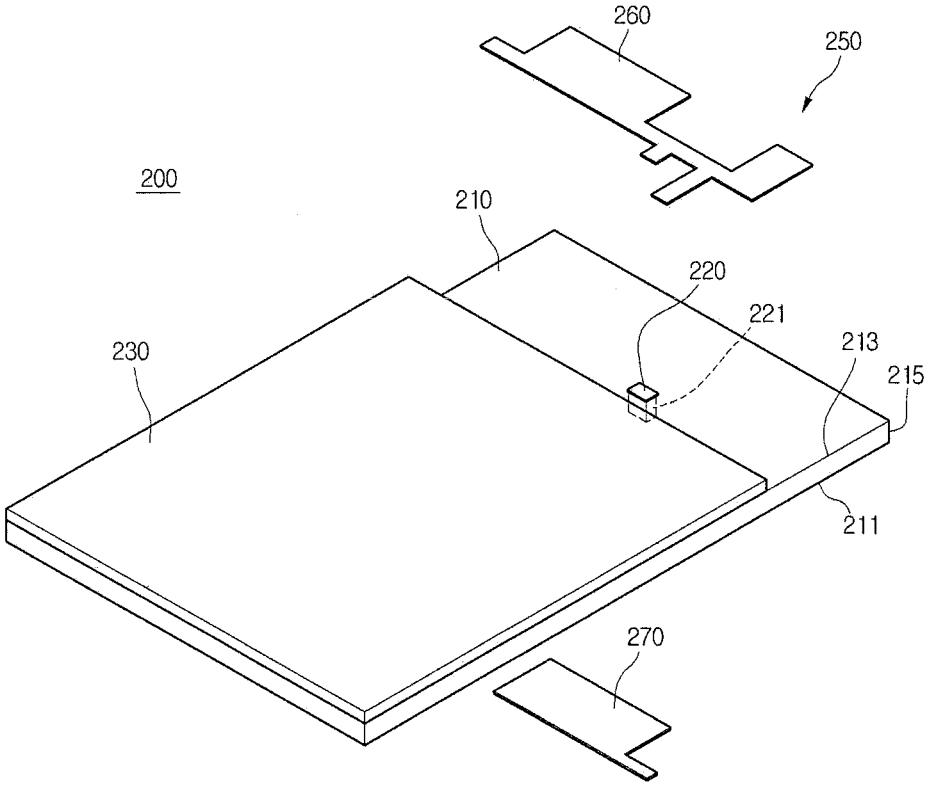
FIG. 5 is an exploded perspective view showing the antenna apparatus according to another embodiment.

Meanwhile, although the above embodiment has been disclosed in that the main device and the sub-device of the antenna device are spaced apart from each other while interposing the mounting member therebetween, the disclosure is not limited thereto. In other words, even if the mounting member is not interposed between the main device and the sub-device, the disclosure can be realized. For instance, as the main device and the sub-device are spaced apart from each other while interposing the substrate therebetween, the disclosure can be realized. FIGS. 4 and 5 show an antenna apparatus according to another embodiment.

FIG. 4 is a perspective view showing the antenna apparatus according to another embodiment, and FIG. 5 is an exploded perspective view showing the antenna apparatus according to another embodiment.

Referring to FIGS. 4 and 5, an antenna apparatus 200 according to the present embodiment includes a substrate 210, a grounding plate 230, and an antenna device 250.

In this case, since the substrate 210 and the grounding plate 230 according to the present embodiment are similar to those according to the embodiment described above, the details of the substrate 210 and the grounding plate 230 will be omitted in order to avoid redundancy. However, according to the present embodiment, the substrate 210 further includes a feeding via 221. The feeding via 221 makes contact with a feeding pad 220. In addition, the feeding via 221 is formed through the substrate 210. In other words, the feeding via 221 allows the feeding pad 220 to be extended from a substrate top surface 213 of the substrate 210 to a substrate bottom surface 211. In addition, the feeding via 221 is exposed at the substrate bottom surface 211 of the substrate 210. Therefore, when the control module (not shown) supplies signals, the signals are sent from the feeding pad 220 to the feeding via 221.

According to the present embodiment, the antenna device 250 is disposed in a device region 219 of the substrate top surface 213 of the substrate 210. In this case, the antenna device 250 is connected to the feeding pad 220. In this case, the antenna device 250 has a structure branching from the feeding pad 220. In addition, the antenna device 250 is disposed on the substrate bottom surface 211 and the substrate top surface 213 of the substrate 210. In addition, the antenna device 250 includes a main device 260 and a sub-device 270. In this case, the substrate 210 is interposed between the main device 260 and the sub-device 270.

The main device 260 makes contact with the feeding pad 220. In addition, the main device 260 is extended from the feeding pad 220. In this case, the main device 260 is extended along the substrate top surface 213 of the substrate 210. In addition, the main device 260 is disposed on the substrate top surface 213 of the substrate 210. Besides, the main device 260 makes contact with the grounding plate 230 in a grounding region 217.

The sub-device 270 makes contact with the feeding via 221. In this case, the sub-device 270 is connected to the feeding pad 220 through the feeding via 221. In addition, the sub-device 270 is extended from the feeding via 221. In this case, the sub-device 270 is extended along the substrate bottom surface 211 of the substrate 210. In addition, the sub-device 270 is disposed on the substrate bottom surface 211 of the substrate 210. In other words, the sub-device 270 overlaps with the main device 260 through the substrate 210. In this case, a portion or the entire portion of the sub-device 270 overlaps with a portion or the entire portion of the main device 260. In this case, the sub-device 270 is spaced apart from the main device 260. The sub-device 270 is spaced apart from the main device 260 by the thickness corresponding to the substrate 210, that is, the height of the substrate lateral side 215. Besides, the sub-device 270 may be open without making contact with the grounding plate 230.

According to the disclosure, the antenna apparatus includes the sub-device overlapped with the main device, so that the resonance frequency band of the antenna apparatus can be enlarged. For instance, the resonance frequency band of the antenna apparatus may be expanded to communication bands including the LTE communication band, the GSM communication band, the EGSM communication band, the DCS communication band, the PCS communication band, and the IMT communication band. Therefore, a communication terminal can use a wider resonance frequency band through a single antenna apparatus. Accordingly, since the communication terminal does not require a plurality of antenna apparatuses, the size of the communication terminal can be reduced.

Meanwhile, the embodiments of the disclosure disclosed in the subject specification and the accompanying drawings are just exemplary and do not limit the present disclosure. In other words, those skilled in the art to which the present invention pertains will know that various modifications and applications which have not been exemplified may be carried out within a range which does not deviate from the essential characteristics of the embodiments.

What is claimed is:

1. An antenna apparatus comprising:

a substrate divided into a grounding region including a grounding plate and a device region including a feeding pad;

a sub-device mounted on the substrate and extended from the feeding pad;

a mounting member provided on a top surface of the substrate, the mounting member including a top surface and a bottom surface, the mounting member covering the feeding pad;

a main device extended from the feeding pad, mounted on the top surface of the mounting member and extending parallel to a plane of the substrate when mounted on the top surface of the mounting member, and overlapped with the sub-device through the mounting member, wherein the top surface of the mounting member contacts the main device, wherein the grounding plate is spaced apart from the sub-device, and connected to the main device, wherein the main device, the mounting member and sub device are laminated at the device region on the top surface of the substrate, wherein the sub-device is between the bottom surface of the mounting member and the top surface of the substrate and extending parallel to the plane of the substrate when mounted on the top surface of the substrate, and wherein the main device comprises a main radiation part, a main feeding part and a main grounding part, the main grounding part extending from the main radiation part and contacting the ground plate formed at the grounding region and spaced apart from the main feeding part, and disposed on a lateral side of the mounting member.

2. The antenna apparatus of claim 1, wherein the sub-device is spaced apart from the main device in the one direction and spaced apart from the grounding plate in another direction perpendicular to the one direction by the mounting member.

3. The antenna apparatus of claim 1, wherein the main device is extended from the feeding pad to the top surface through the lateral side of the mounting member.

4. The antenna apparatus of claim 3, wherein the main feeding part contacts the feeding pad and is disposed to the lateral side of the mounting member; and wherein the main radiation part is connected to the main feeding part, contacts the top surface of the mounting member, and overlaps the sub-device.

5. The antenna apparatus of claim 4, wherein the sub-device comprises:

a sub-feeding part making contact with the feeding pad; and a sub-radiation part connected to the sub-feeding part while overlapping with the main radiation part.

* * * * *